United States Patent [19]

Bishop et al.

[11] Patent Number: 4,719,653

[45] Date of Patent: Jan. 19, 1988

[54] ADJUSTABLE BODY SUPPORT DEVICE

[76] Inventors: Randy A. Bishop; Victoria A. Bishop, both of 1878 Stanley, Birmingham, Mich. 48009

[21] Appl. No.: 815,806

[22] Filed: Jan. 2, 1986

[51] Int. Cl.[4] ..... A47C 1/34

[52] U.S. Cl. ..... 4/572; 297/28

[58] Field of Search ..... 4/572, 571, 575–577, 4/579; 297/16, 19, 27, 28, 377, 408

[56] References Cited

U.S. PATENT DOCUMENTS

| | | | |
|---|---|---|---|
| 662,557 | 11/1900 | Cole | 297/27 |
| 2,216,317 | 10/1940 | Karish | 297/19 |
| 2,285,900 | 6/1942 | Chapman | 4/572 |
| 2,460,308 | 2/1949 | Pribil | 4/572 |
| 2,647,561 | 8/1953 | Szabo | 4/572 |
| 2,697,480 | 12/1954 | DuBois et al. | 4/572 |
| 2,968,814 | 1/1961 | Ashby, Jr. | 4/575 |
| 4,084,849 | 4/1978 | Ishida et al. | 297/377 |

FOREIGN PATENT DOCUMENTS

| | | | |
|---|---|---|---|
| 1086060 | 2/1955 | France | 297/28 |

*Primary Examiner*—Henry J. Recla
*Assistant Examiner*—L. J. Peters
*Attorney, Agent, or Firm*—Gerald E. McGlynn, Jr.

[57] ABSTRACT

An adjustable body support device comprises a seating portion for supporting the lower torso of the body and a back portion for supporting the upper torso of the body. An arm rest is fixedly secured to the seating portion for supporting the arms of the body and is selectively engageble and disengageable with the back portion to hold the latter in a predetermined position relative to the seating portion. An adjustable leg is hingedly connected to the back portion for selectively adjusting the back portion with respect to the support surface. An adjusting rack and bale may be provided for selectively adjusting the back portion in a series of stepped levels.

15 Claims, 7 Drawing Figures

ADJUSTABLE BODY SUPPORT DEVICE

TECHNICAL FIELD

The subject invention relates to adjustable body support devices and, particulary, adjustable body support devices utilized for holding small children to facilitate bathing.

BACKGROUND ART

Devices for holding infants and small children during bathing and hair washing have been used in the past. These devices usually consisted of a one-piece molded plastic or a sling-type chair. The molded plastic device is solid and non-adjustable. This device has an inclined back support portion and an opposite inclined portion combined to retain the child. The sling-type chair has an adjustable tubular support frame and a fabric material connected to the frame similar to a "hammock" to retain the child.

The problem with these devices is either that they are not adjustable, i.e. the back support portion is not adjustable with respect to the seat support portion, or there is no arm rest upon which to place the person's forearms.

STATEMENT OF INVENTION AND ADVANTAGES

An adjustable body support device comprises a seating means for supporting the lower torso of the body. A back means supports the upper torso of the body. Further, an arm rest means is fixedly secured to the seating means for supporting the arms of the body. The arm rest means is selectively engageable and disengageable with the back means to lower the latter to a predetermined position relative to the seating means.

Also, adjustable legs are hingedly connected to the back means for selectively adjusting the back means with respect to a support surface.

Further, a support means supports the seating means from a support surface and an adjustment means selectively adjusts the back means in a series of stepped levels.

Accordingly, a device using the subject invention can be used to rest the arms of the body during bathing. Also, the back support portion may be selectively adjusted with respect to the seat support portion to provide different positions for bathing with respect to a support surface. Further, the arm rest is selectively engageable and disengageable with the back support portion.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
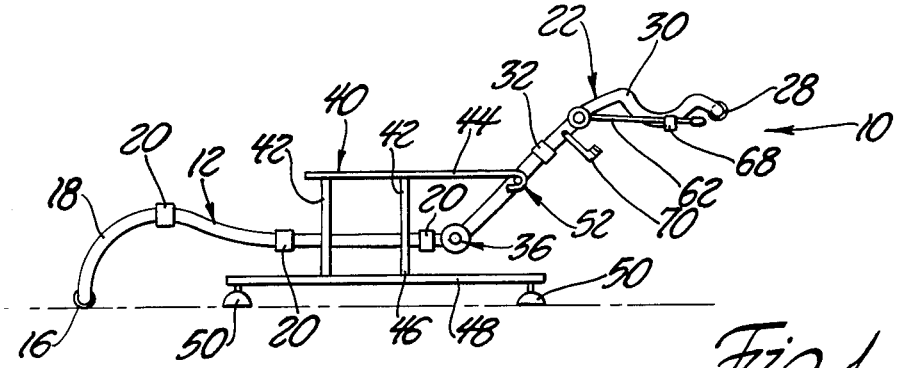
FIG. 1 is a side elevational view of a preferred embodiment of the invention.
Figure 2:
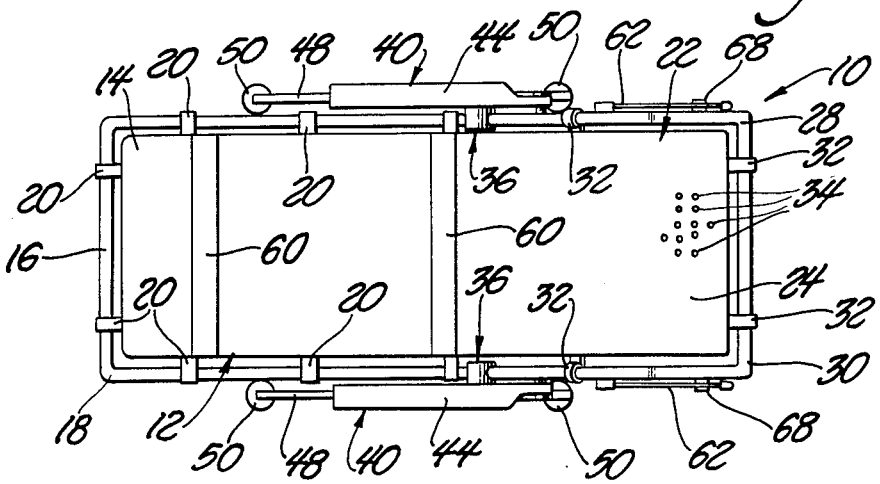
FIG. 2 is a top plan view of the invention.

An adjustable body support device is generally shown at 10 in FIGS. 1 and 2. The device 10 comprises a seating means 12 for supporting the lower torso of the body. The seating means 12 comprises a seat portion 14 having a toe portion 16 adapted to rest upon a support surface. For example, the seat portion 14 may be made of a flexible material such as fabric, with a tubular frame 18. The seat portion 14 may include fabric straps 20 connected to the seat portion 14 in the form of a "loop" similar to a "belt buckle" on a pair of pants. The fabric straps 20 are slipped over the tubular frame 18 to hold the seat portion 14 to the tubular frame 18. The toe portion 16 may be part of the tubular frame 18 or a rubber material encompassing part of the tubular frame 18 to rest upon the support surface. However, the seat portion 14 and toe portion 16 may be made as one solid unit of molded plastic. Further, the molded plastic seat portion 16 and toe portion 18 may be formed to conform to the shape of the legs and buttocks.

The device 10 further comprises a back means 22 for supporting the upper torso of the body. The back means 22 comprises a back rest portion 24 having a head rest portion 26 suitably contoured to receive the head of the body and terminating in an extension 28 for engagement with the support surface. The back rest portion 24 may be similar to the seat portion 14, i.e. being made of a flexible material such as fabric with a tubular frame 30. The back rest portion 24 and the head rest portion 26 include fabric straps 32 connected to the back rest portion 24 and the head rest portion 26 in the form of a "loop" similar to "belt buckle" on a pair of pants. The fabric straps 32 are slipped over the tubular frame 30 to hold the back rest portion 24 and the head rest portion 26 to the tubular frame 30. The extension 28 may be part of the tubular frame 30 or a rubber material encompassing part of the tubular frame 30 to rest upon the support surface. However, the back rest portion 24 and the head rest portion 26 is preferably one solid unit made of molded plastic. Further, the head rest portion 26 includes at least one, preferably a plurality of, drain aperture 34 for draining liquid from the head rest portion 26.

The back means 22 further comprises a pivotal means 36 pivotally connecting the back rest portion 24 to the seating means 12 for allowing the back means 22 to rotate with respect to the seating means 12. In other words, the pivotal means 36 allows the back means 22 to rotate with respect to the seating means 12. The pivotal means 36 may comprise a pin 38 or the like to allow rotation between the back means 22 and the seating means 12.

The device 10 further comprises arm rest means 40 fixedly secured to the seating means 12 for supporting the arms of the body. The arm rest means 40 is selectively engageable and disengageable with the back means 22 to lower the latter in a predetermined position relative to the seating means 12.

The arm rest means 40 comprises at least one vertically upstanding post 42 fixedly secured to each of the opposite side portions of the seating means 12. The arm rest means 40 further comprises an arm rest member 44 fixedly secured to the upper end of each of the posts 42 and extending horizontally with respect to the support means and terminating rearwardly of the posts 42. The arm rest means 40 includes at least one leg 46, preferably two, depending from each of the side portions of the seating means 12. The arm rest means 40 further includes a support member 48 connected to the end of the legs 46 and extending horizontally with respect to the support surface. The support member 48 includes suction cups 50 longitudinally spaced on each of the support members 46 and adapted to grippingly engage the support surface.

The arm rest means 40 further includes connector means 52 for engaging and disengaging the back means 22 with the arm rest means 40. The connector means 52 comprises a hook portion 54 at the trailing edge of the arm rest member 44. The connector means 52 further comprises a pin 56 connected to the back means 22 and selectively engageable and disengageable with the hook portion 54 for controlling the relative inclination of the back rest portion 24 with respect to the seat portion 14. In other words, slot 58 in the tubular frame 18 of the seat portion 14 allows the pin 38 to move in the slot when the connector means 52 is engaged and disengaged. The pin 56 moves in and out of engagement with the hook portion 54 to allow the back means 22 to rotate with respect to the seating means 12. However, any suitable connector means such as a spring biased plunger or the like may be used to allow engagement and disengagement of the back means 22 with the arm rest means 40.

The device 10 further includes restraining means 60 operatively secured to each of the side portions of the back means 22 and the seating means 12. The restraining means 60 is engageable with the chest and thigh portions of the body for restraining movement of the body, respectively. The restraining means 60 may comprise conventional "velcro" type of fasteners.

Figure 3:
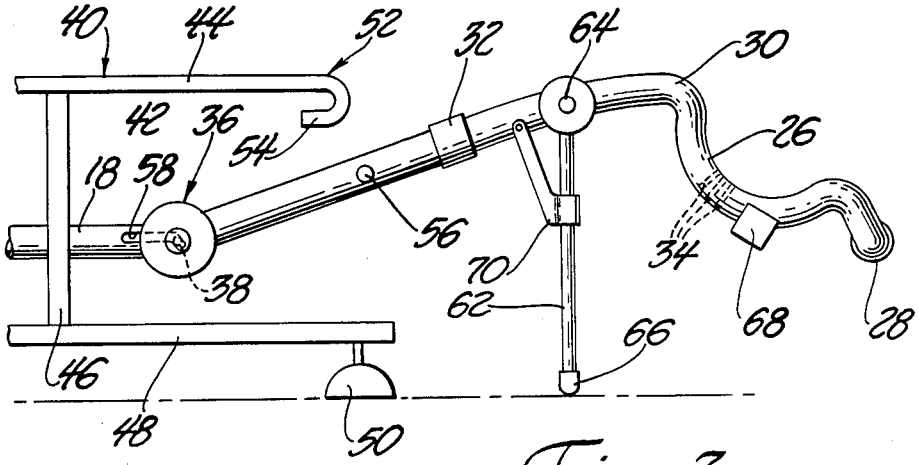
FIG. 3 is an enlarged fragmentary view of FIG. 1 showing the adjustable legs of the invention in an intermediate position.

As illustrated in FIG. 3, the device 10 further comprises adjustable legs 62 hingedly connected to the back means 22 for selectively adjusting the back means 22 with respect to the support surface. The adjustable leg 62 comprises a leg member 62 hingedly connected at one end to the back rest portion 24 of the back means 22. The adjustable leg 62 includes a pin 64 connected to the tubular frame 30 of the back rest portion 24 for allowing the adjustable leg to pivot or rotate. The adjustable leg 62 includes a tip 66 at the free end of the leg member 62 engaging the support surface. The tip may be rubber or the like. The adjustable leg 62 further includes fastening means 68 for selectively maintaining the leg member 62 in a stowable position. The adjustable leg 62 further includes stop means 70 for locating and maintaining the leg in a vertical position. The fastening means 68 and stop means 70 may comprise a U-shaped configuration in cross- section which expands and contracts as the adjustable leg 62 is moved into and out of engagement, respectively, to hold the adjustable leg 62 into position.

Figure 4:
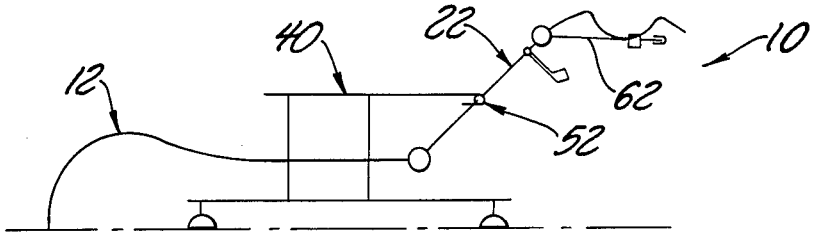
FIG. 4 is a schematic representation of the invention in the full upright position.
Figure 5:
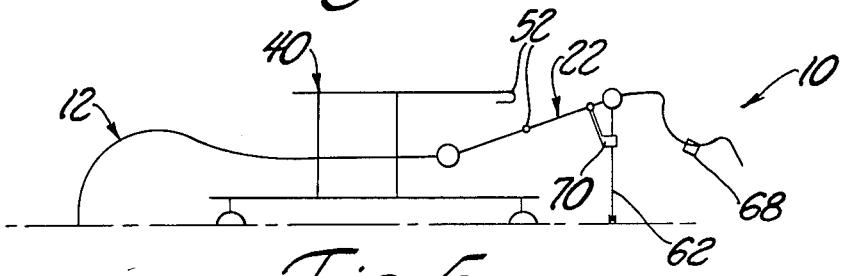
FIG. 5 is a schematic representation of the invention in the intermediate position of FIG. 3.

As illustrated in FIG. 4, the device 10 is in the full upright position with the back means 22 engaged with the arm rest means 40. The person is placed in the device 10 and secured in place with the restraining means 60. As illustrated in FIG. 5, the back means 22 is disengaged from the arm rest means 40 and the back means 22 is lowered into a predetermined position. The adjustable leg 62 is disengaged from the fastening means 68 and engaged in the stop means 70 in a vertical upright position. This predetermined position is an intermediate position between the full upright position and the fully lowered position.

Figure 6:
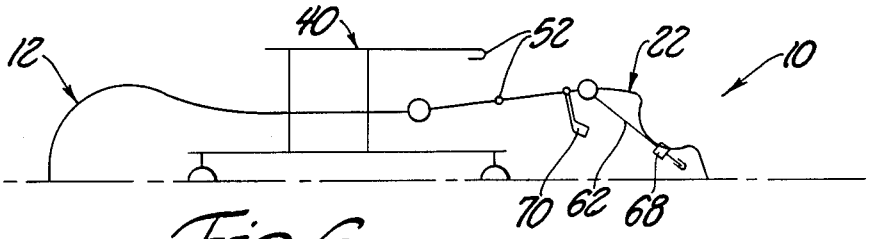
FIG. 6 is a schematic representation of the invention in the fully down position.

As illustrated in FIG. 6, the back means 22 is lowered to engage the support surface in the fully lowered position. The adjustable leg 62 is disengaged from the stop means 70 and stored in the fastening means 68. The extension 28 of the back means 22 rests upon the support surface. The process may be repeated.

Figure 7:
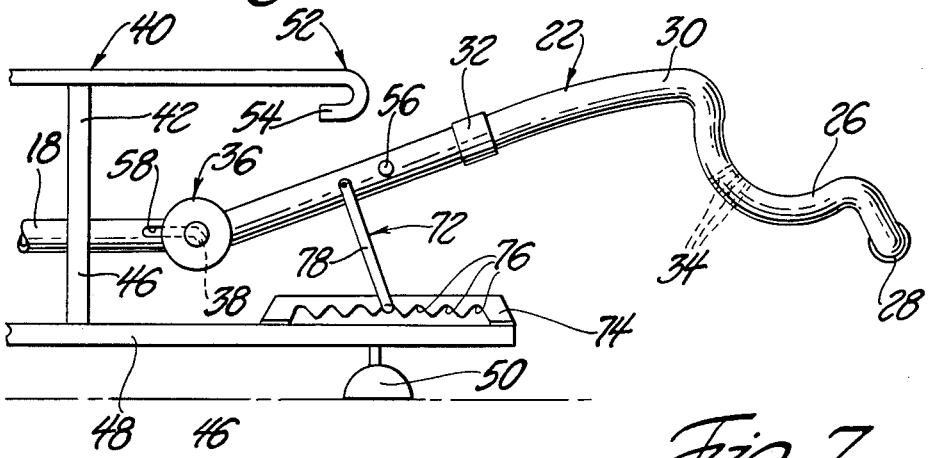
FIG. 7 is an enlarged view corresponding generally to FIG. 3 but showing an alternate embodiment of the subject invention.

As illustrated in FIG. 7, an alternate embodiment of the device 10 includes adjustment means 72 for selectively adjusting the back means 22 in a series of stepped levels. The adjustment means 72 comprises a rack 74 horizontally fixed along the support member 46 and having a plurality of notches 76. The adjustment means 72 further comprises a bail 78 pivotally connected to the back means 22 for engaging and disengaging the notches 76 for selectively raising and lowering the back means 22 with respect to the support surface. In other words, the device 10 omits the adjustable leg 62 and replaces the adjustable leg 62 with an adjustment means 72 comprising a rack 74 and a bail 78. The back means 22 is selectively engageable and disengageable with the arm rest means 40.

In operation, the back means 22 is disengaged from the arm rest means 40. The bail 78 is moved into and out of the notches 76 of the rack 74 to obtain the desired height of the back means 22 with respect to the support surface. The back means 22 may be positioned in any of the positions as illustrated in FIGS. 4 through 6.

Further, any embodiment of the device 10 may be stored in a stowable position. More specifically, the back means 22 is folded over or rotated to rest upon the seating means 12 in a collapsed position. The back means 22 may be held to the seating means 12 by any suitable means such as velcro straps. Once in a collapsed or stowable position, the device 10 may be grippingly attached to a storing surface, such as a shower wall, by the suction cups 50.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. An adjustable body support device comprising seating means for supporting the lower torso of the body, back means for supporting the upper torso of the body, and an arm rest means non-rotatably mounted and permanently positioned to said seating means for supporting the arms of the body and said arm rest means being selectively engageable and disengageable with said back means to hold the latter in a predetermined position relative to said seating means.

2. A device as set forth in claim 1 wherein said arm rest means comprises at least one vertically upstanding post fixedly secured to each of the opposite side portions of said seating means, an arm rest member fixedly secured to the upper end of each of said posts and extending horizontally with respect to a support surface and terminating rearwardly of said post, at least one leg depending from each of the side portions of said seating means, a support member connected to the end of said legs and extending horizontally with respect to the support surface, suction cups longitudinally spaced on each of said support members adapted to grippingly engage the support surface, and connector means for engaging and disengaging said back means with said arm rest means.

3. A device as set forth in claim 2 wherein said back means comprises a back rest portion having a head rest portion suitably contoured to receive the head of the body and said back rest portion terminating in an extension for engagement with the support surface and pivotal means pivotally connecting said back means to said seating means to allow said back means to pivot with respect to said seating means.

4. A device as set forth in claim 3 wherein said head rest portion includes at least one drain aperture for draining liquid from said head rest portion.

5. A device as set forth in claim 4 wherein said seating means comprises a seat portion having a toe portion adapted to rest upon the support surface.

6. A device as set forth in claim 5 including restraining means operatively secured to each of the side portions of said back means and said seating means engageable respectively with the chest and thigh portions of the body for restraining movement of the body.

7. A device as set forth in claim 6 wherein said connector means comprises a hook portion at the trailing edge of each of said arm rest members and pins carried by said back rest portion selectively engageable and disengageable with said hook portion for controlling the relative inclination of said back rest portion with respect to said seat portion.

8. An adjustable body support device comprising seating means for supporting the lower torso of the body, back means for supporting the upper torso of the body, arm rest means non-rotatably mounted and permanently positioned to said seating means for supporting the arms of the body and said arm rest means being selectively engageable and disengageable with said back means to hold the latter in a predetermined position relative to said seating means, and adjustable legs hingedly connected to said back means for selectively adjusting said back means with respect to a support surface.

9. A device as set forth in claim 8 wherein said arm rest means comprises at least one vertically upstanding post fixedly secured to each of the opposite side portions of said seating means, an arm rest member fixedly secured to the upper end of each of said posts and extending horizontally with respect to the support surface and terminating rearwardly of said post, at least one leg depending from each of the side portions of said seating means, a support member connected to the end of said legs and extending horizontally with respect to the support surface, suction cups longitudinally spaced on said support member adapted to grippingly engage the support surface, and connector means for engaging and disengaging said back means with said arm rest means.

10. A device as set forth in claim 9 wherein said adjustable leg comprises a leg member hingedly connected at one end to said back means, a tip at the free end of said leg member engageable with the support surface, fastening means for selectively maintaining said leg in a stowed position, and stop means for locating and maintaining said leg in a substantially vertical position engaging the support surface.

11. A device as set forth in claim 10 wherein said back means comprises a back rest portion having a head rest portion suitably contoured to receive the head of the body and said back rest portion terminating in an extension for engagement with the support surface and means pivotally connecting said back rest portion to said seating means to allow said back means to pivot with respect to said seating means.

12. A device as set forth in claim 11 wherein said head rest portion includes at least one drain aperture for draining liquid from said head rest portion.

13. A device as set forth in claim 12 wherein said seating means comprises a seat portion having a toe portion adapted to rest upon the support surface.

14. A device as set forth in claim 13 including restraining means operatively secured to each of the side portions of said back means and said seating means engageable respectively with the chest and thigh portions of the body for restraining movement of the body.

15. A device as set forth in claim 14 wherein said connector means comprises a hook portion at the trailing edge of each of said arm rest members and pins carried by said back rest portion selectively engageable and disengageable with said hook portion for controlling the relative inclination of said back rest portion with respect to said seat portion.

* * * * *